US007891986B2

(12) United States Patent
Wu

(10) Patent No.: US 7,891,986 B2
(45) Date of Patent: Feb. 22, 2011

(54) CABLE ASSEMBLY WITH EMI PROTECTION

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/460,106

(22) Filed: Jul. 13, 2009

(65) Prior Publication Data

US 2011/0005825 A1 Jan. 13, 2011

(51) Int. Cl.
*H01R 13/62* (2006.01)

(52) U.S. Cl. ..... 439/76.1; 439/607.41; 439/358

(58) Field of Classification Search ..... 439/76.1, 439/607.41, 607.46, 607.47, 607.49, 607.56, 439/357, 358, 606
See application file for complete search history.

(56) References Cited

U.S. PATENT DOCUMENTS 6,431,901 B1 * 8/2002 Yeh ..... 439/357
7,175,444 B2 * 2/2007 Lang et al. ..... 439/76.1
7,303,438 B2 * 12/2007 Dawiedczyk et al. .. 439/607.53
7,364,465 B2 * 4/2008 Wu ..... 439/607.55
7,410,365 B2 * 8/2008 Wu ..... 439/76.1
7,445,484 B2 * 11/2008 Wu ..... 439/352
7,448,897 B2 11/2008 Dawiedczyk et al.

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

A cable assembly comprises a housing defining a body portion with a front face, a pair of upper and lower tongue portions respectively extending forwardly from a top and bottom sides of the front face. The housing is configured by a metallic lower cover, a metallic upper cover assembled to the metallic lower cover and an insulative stand assembled to the metallic upper cover. A printed circuit board is disposed in a receiving room of the body portion of the housing and defines a mating portion extending forwardly from the front face of the housing and disposed between the upper and lower tongue portions and a terminating portion opposite to the mating portion. A cable is terminated to the terminating portion of the printed circuit board and extended out of the housing. And a latch is assembled to the insulative stand of the housing.

20 Claims, 13 Drawing Sheets

CABLE ASSEMBLY WITH EMI PROTECTION

FIELD OF THE INVENTION

The present invention relates to a cable assembly, and more particularly to a cable assembly with a metallic housing for EMI protection.

DESCRIPTION OF PRIOR ART

Generally, a few of cable assembly used in an internal space of the server or other electrical device will not influenced by EMI seriously, the cable assembly do not have a shield for anti-EMI. However, as more and more high speed cable assemblies are applied in the internal of the server or other electrical device, so the cable assembly will be influenced by EMI more or less which are produced by other electrical components in the server or itself. If the cable assembly is influenced by EMI, the stability of signal transmission of the cable assembly will be affected.

As discussed above, an improved cable assembly overcoming the shortages of existing technology is needed.

SUMMARY OF THE INVENTION

Accordingly, an object of the present invention is to provide a cable assembly with EMI protection.

In order to achieve the above-mentioned objects, a cable assembly comprises a housing defining a body portion with a front face, a pair of upper and lower tongue portions respectively extending forwardly from a top and bottom sides of the front face. The housing is configured by a metallic lower cover, a metallic upper cover assembled to the metallic lower cover and an insulative stand assembled to the metallic upper cover. A printed circuit board is disposed in a receiving room of the body portion of the housing and defines a mating portion extending forwardly from the front face of the housing and disposed between the upper and lower tongue portions and a terminating portion opposite to the mating portion. A cable is terminated to the terminating portion of the printed circuit board and extended out of the housing. And a latch is assembled to the insulative stand of the housing.

Other objects, features and advantages of the invention will be apparent from the following detailed description taken in connection with the accompanying drawings.

DETAILED DESCRIPTION OF PREFERRED EMBODIMENTS

Figure 1:
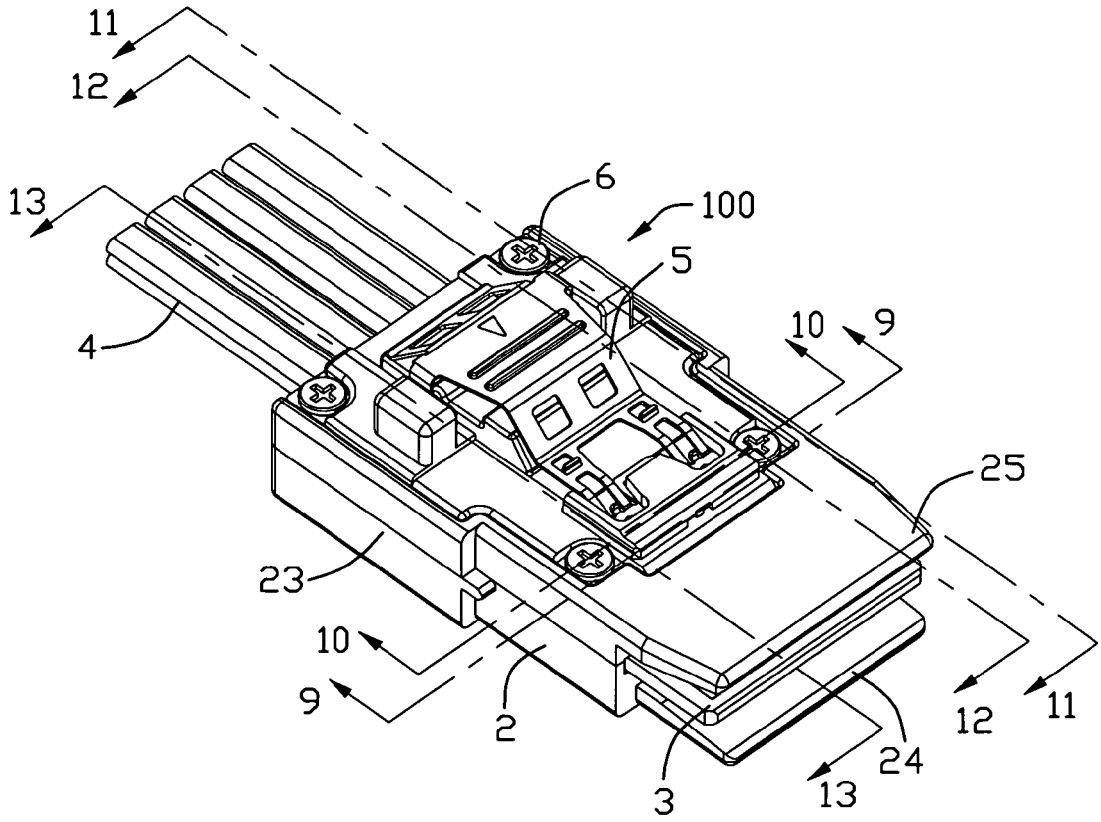
FIG. 1 is a perspective view of a cable assembly in accordance with the present invention.

Reference will now be made to the drawing figures to describe the present invention in detail.

Figure 2:
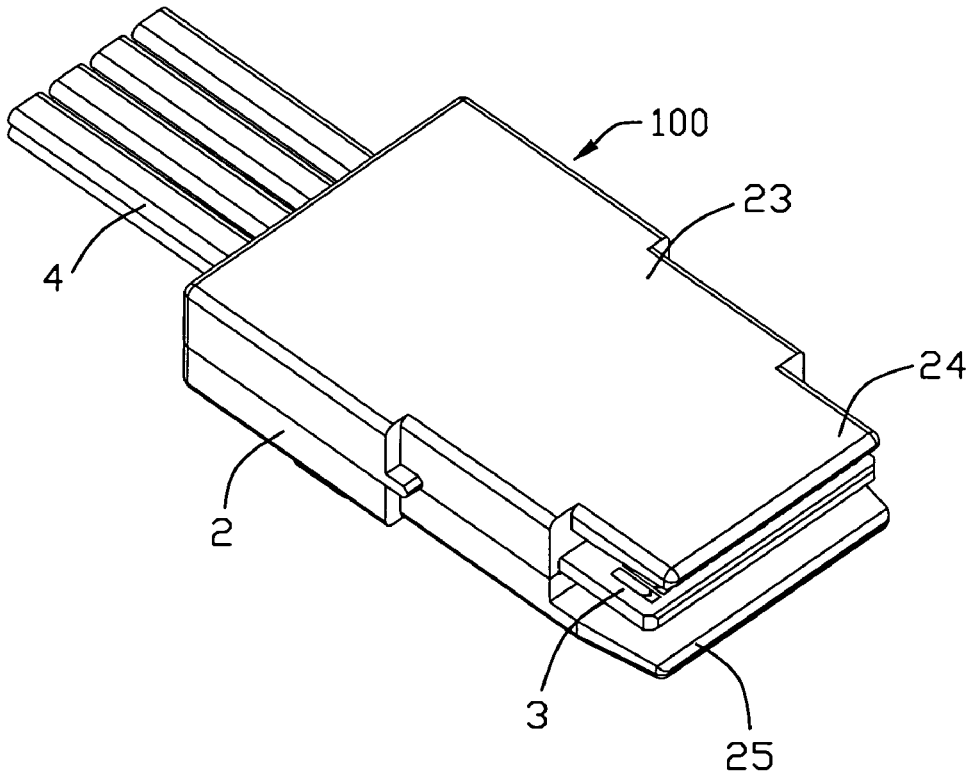
FIG. 2 is similar to FIG. 1, but viewed from another aspect.
Figure 3:
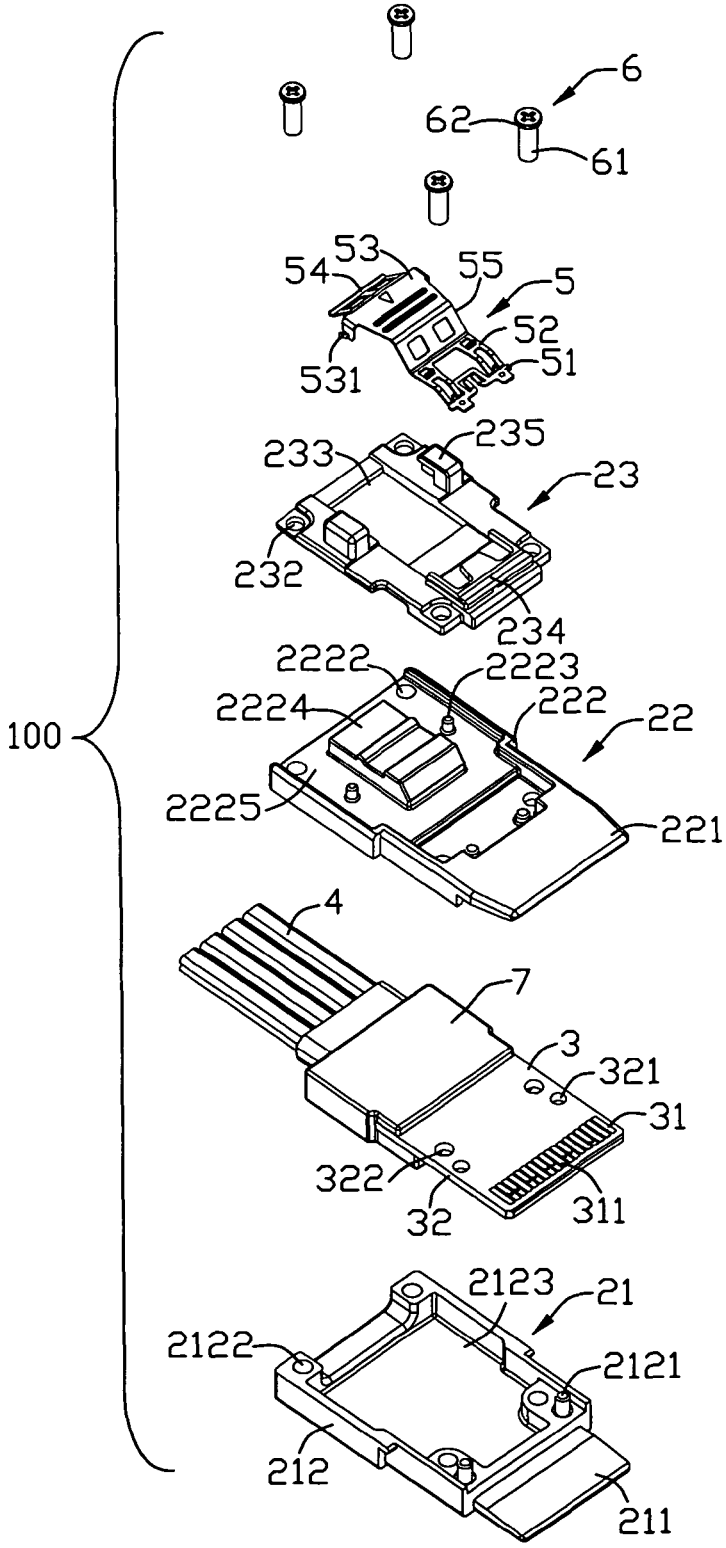
FIG. 3 is an exploded, perspective view of the cable assembly of FIG. 1.
Figure 4:
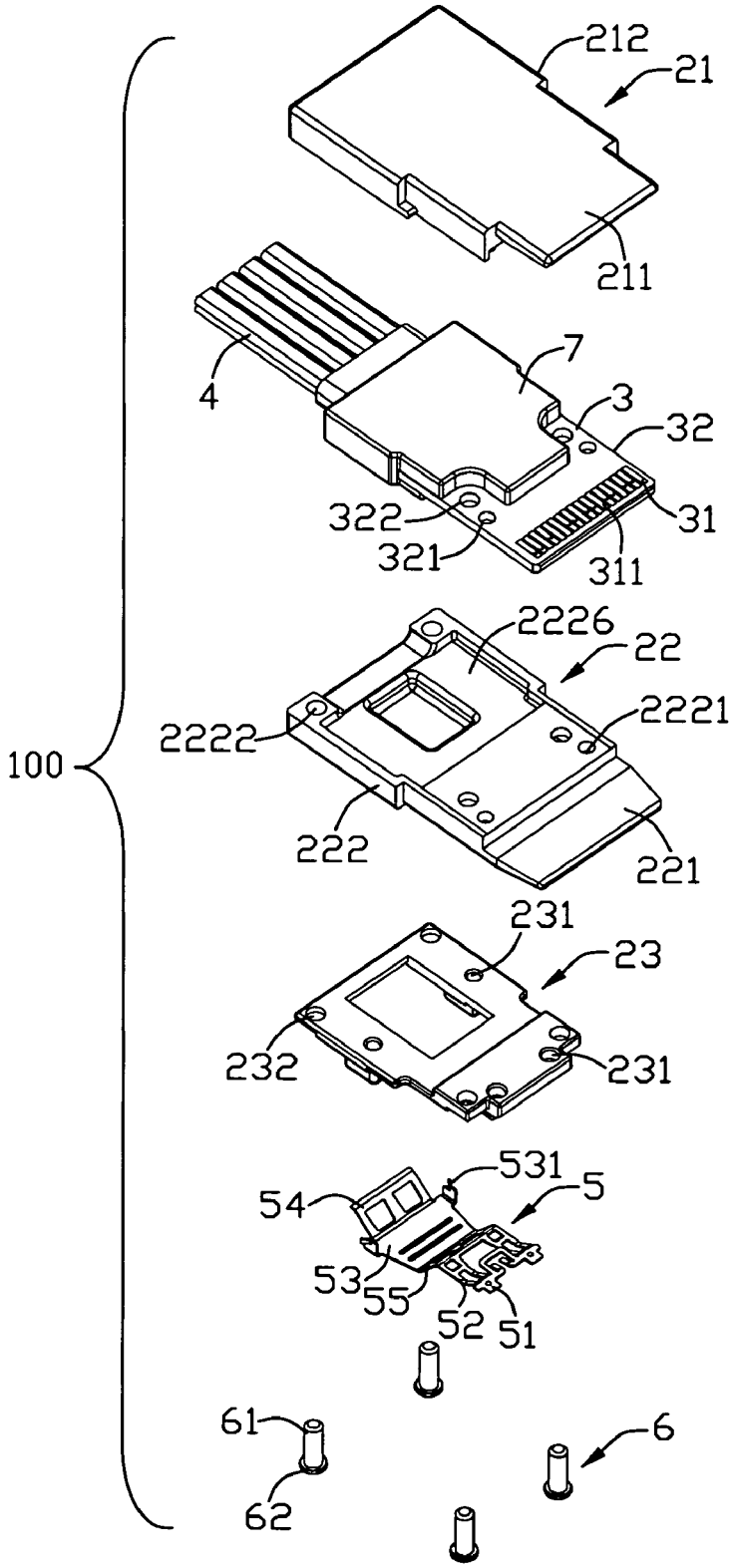
FIG. 4 is an exploded, perspective view of the cable assembly of FIG. 2.
Figure 5:
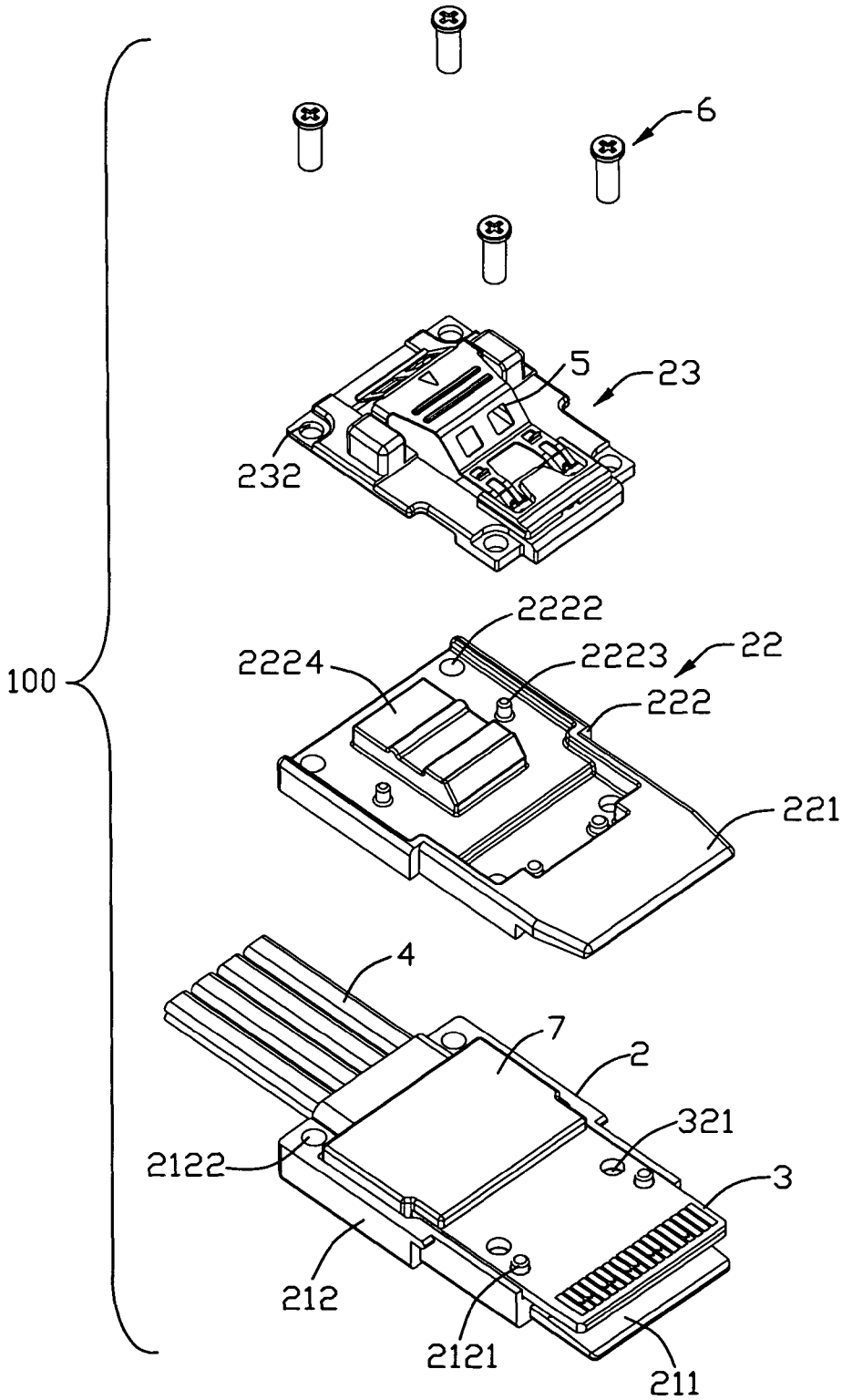
FIG. 5 is a partially assembled view of the cable assembly of FIG. 1.
Figure 6:
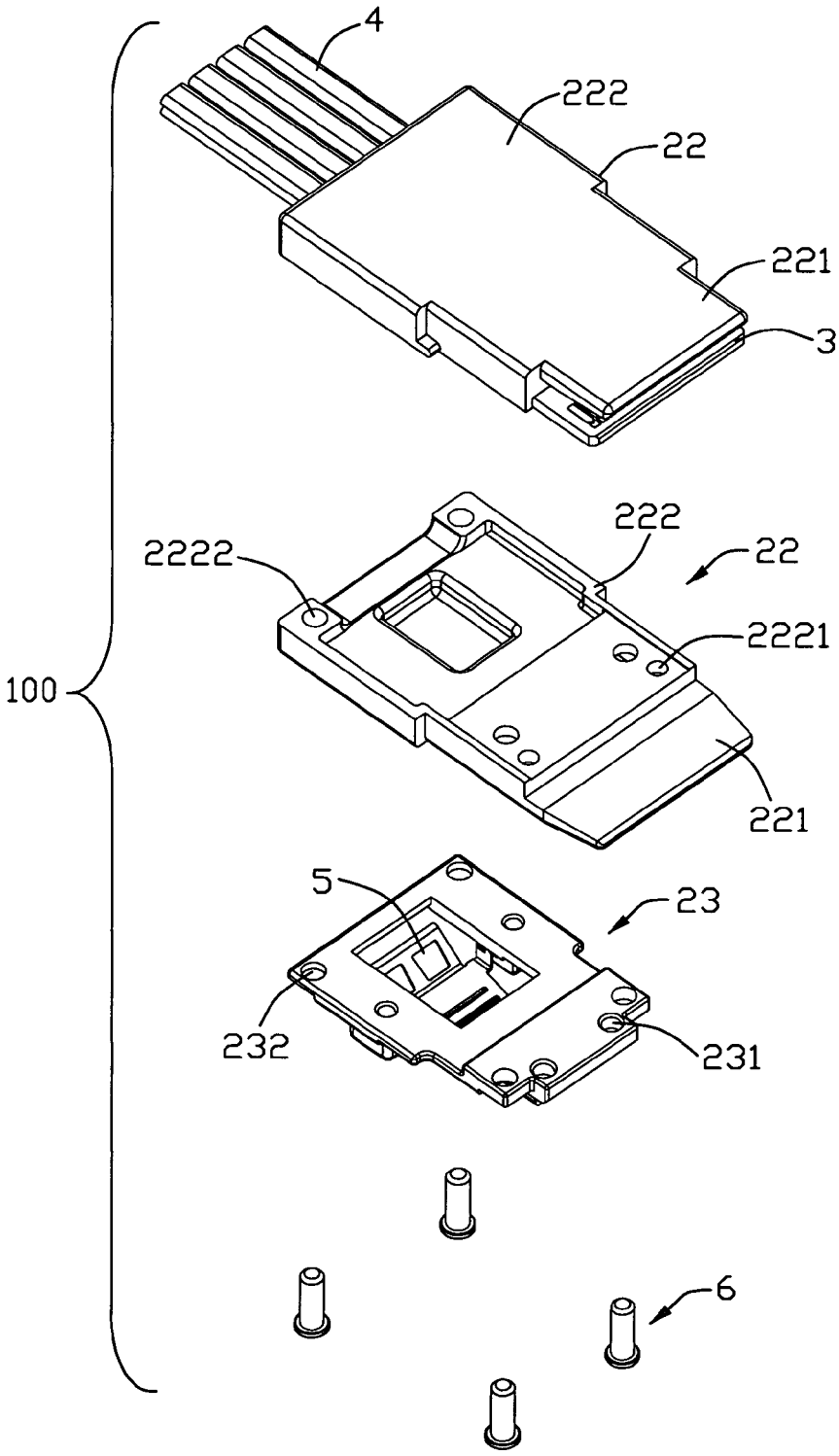
FIG. 6 is a partially assembled view of the cable assembly of FIG. 2.
Figure 7:
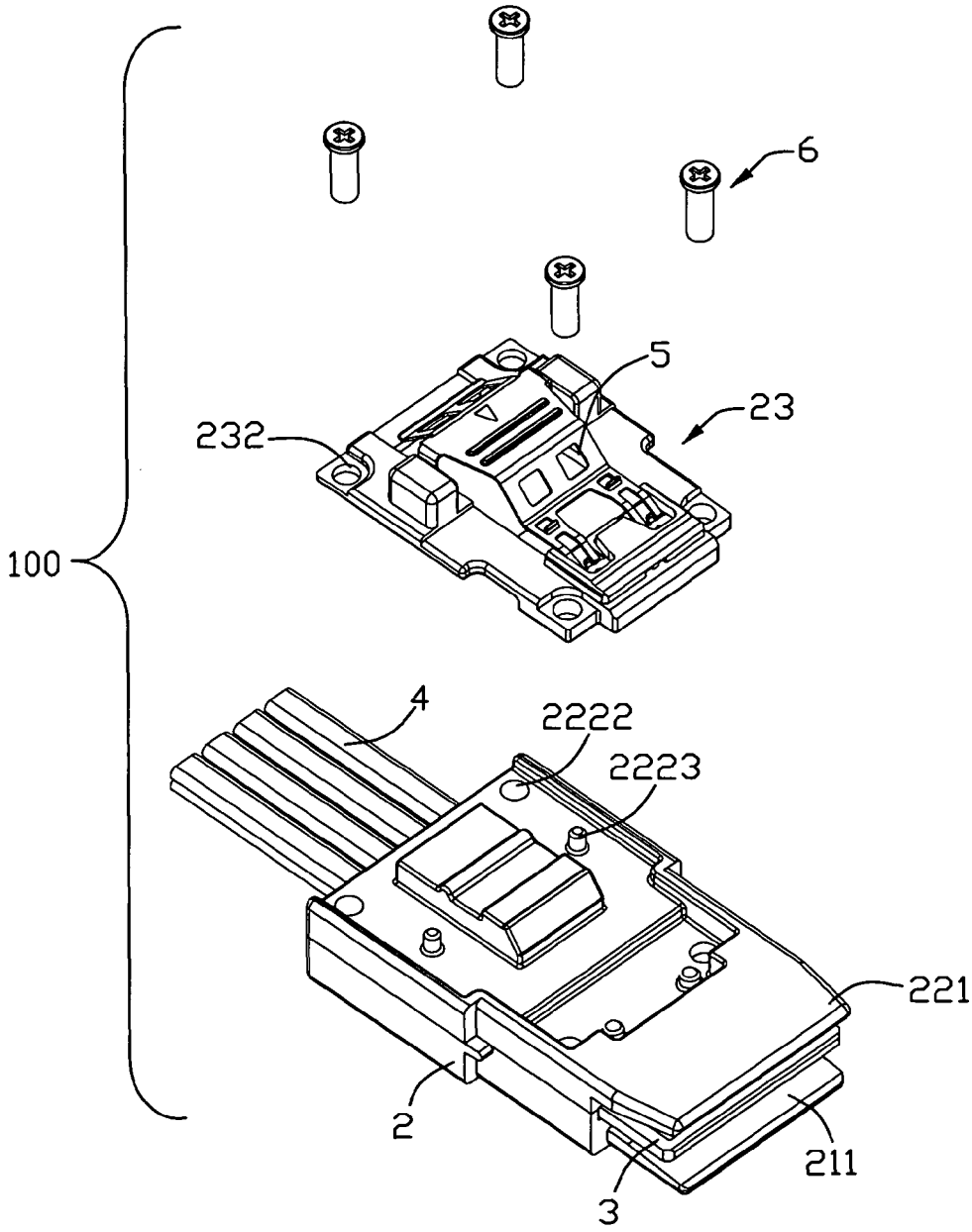
FIG. 7 is an another partially assembled view of the cable assembly of FIG. 1.
Figure 8:
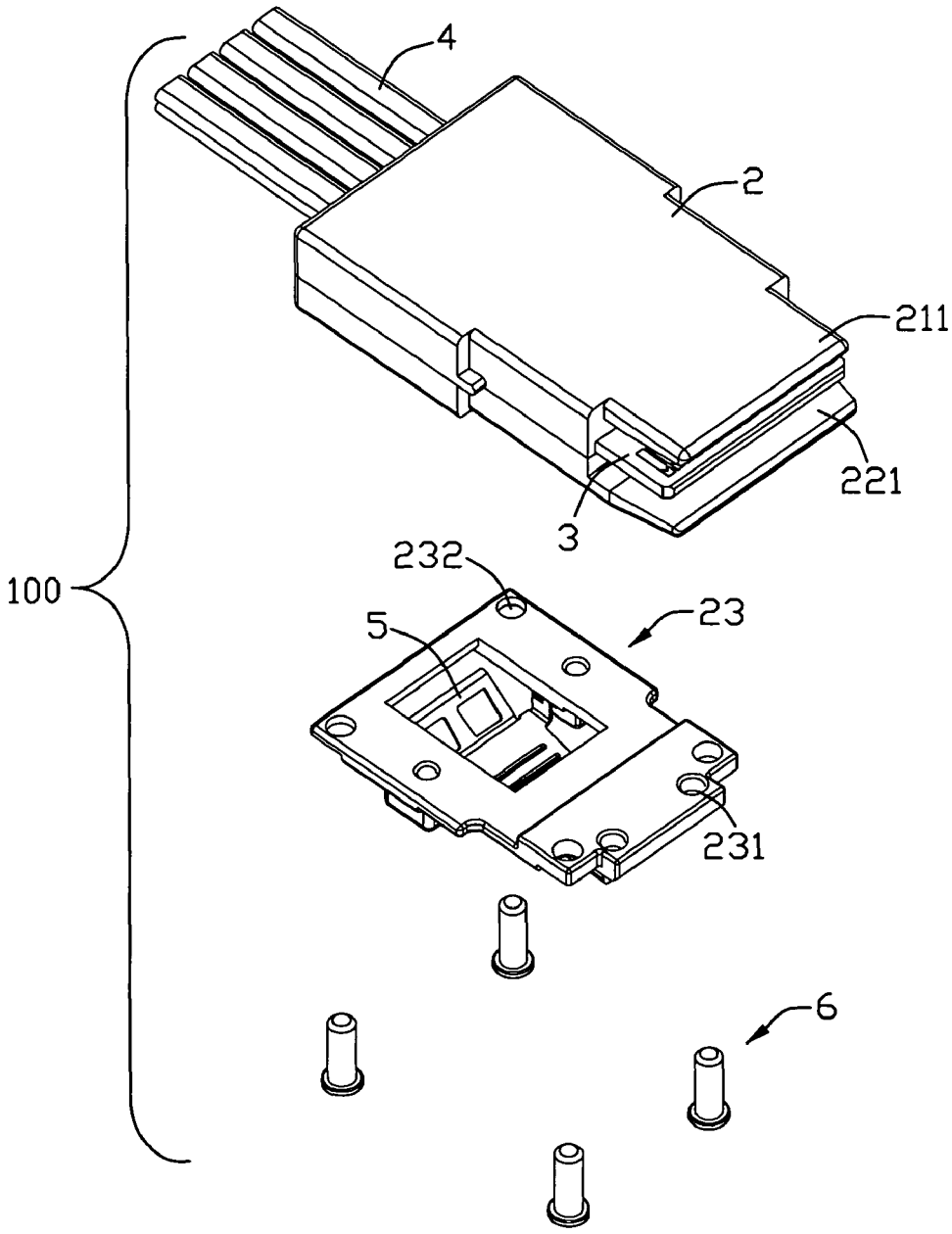
FIG. 8 is an another partially assembled view of the cable assembly of FIG. 2.

FIGS. 1 and 2 illustrate perspective views of a cable assembly 100 made in accordance with the present invention. The cable assembly 100 comprises a housing 2, a printed circuit board 3 disposed in the housing 2 and a plurality of cables 4 electrically connected to a rear end of the printed circuit board 3. The housing 2 defines a body portion 23 and a pair of spaced tongue portions 24, 25 extending forwardly from a front face of body portion 23. The printed circuit board 3 defines a mating portion 31 at its front end and extending forwardly from the front face of the body portion 23 of the housing 2. An inner molding 7 is formed on a connection between the printed circuit board 3 and the cable 4. The cable assembly 100 further defines a latch 5 assembled to a top surface of the housing 2. Four engaging means 6, such as screws, are used to lock the printed circuit board 3 to the housing 2.

Referring to FIGS. 1 to 4, the housing 2 is comprised by a lower cover 21, an upper cover 22 assembled to the lower cover 21 and a stand 23 assembled to the upper cover 22. The lower cover 21 and upper cover 22 are die-cast or stamped from metallic material to provide EMI protection. The stand 23 is preferably made of plastic material, in another embodiment, the stand 23 may be die-cast or stamped from metal.

The lower cover 21 defines a body portion 212 and a lower tongue portion 211 extending forwardly from a front face of the body portion 212. The body portion 212 defines a pair of positioning posts 2121 extending upwardly from a top surface of the body portion 212 and disposed at two sides of a front end of the body portion 212. The body portion 212 defines four receiving holes 2122 extending downwardly for a distance from a top surface thereof and disposed at four corners thereof. The body portion 212 further defines a recess 2123 extending downwardly from the top surface thereof.

The upper cover 22 defines a body portion 222 and an upper tongue portion 221 extending forwardly from a front face of the body portion 222. The body portion 222 has an upper surface and a lower surface opposite to the upper surface. The body portion 222 of the upper cover 22 defines an recessed area 2225 formed in the upper surface thereof and groove 2226 formed in the lower surface thereof. A pair of receiving holes 2221 are formed in the lower surface of a front end of the upper cover 22 for receiving a pair of top ends of the positioning posts 2121 of the lower cover 21. Four through holes 2222 are formed at four corners of the body portion 222 and in alignment with the receiving holes 2122 of the lower cover 21 in a vertical direction. And, four positioning posts 2223 extends upwardly from a bottom surface of the recessed area 2225 and are used to position the stand 23. Further, a platform 2224 is formed in the recessed area 2225 and disposed between two positioning posts 2223.

The stand 23 defines four through holes 232 formed at four corners thereof and corresponding to the four through holes 2222 and four receiving holes 2122 respectively formed in the upper cover 22 and lower cover 21. The stand 23 further defines four receiving holes 231 formed in a bottom surface thereof for receiving the corresponding positioning posts 2223 formed in the recessed area 2225 of the upper cover 22. A rectangular through hole 233 is formed in a middle and rear section of the stand 23. The stand 23 further defines an engaging portion 234 formed on a top surface of a front section thereof and a pair of ear sections 235 located at two sides of the rectangular through hole 233 respectively with an opening (not figured) toward each other.

Figure 11:
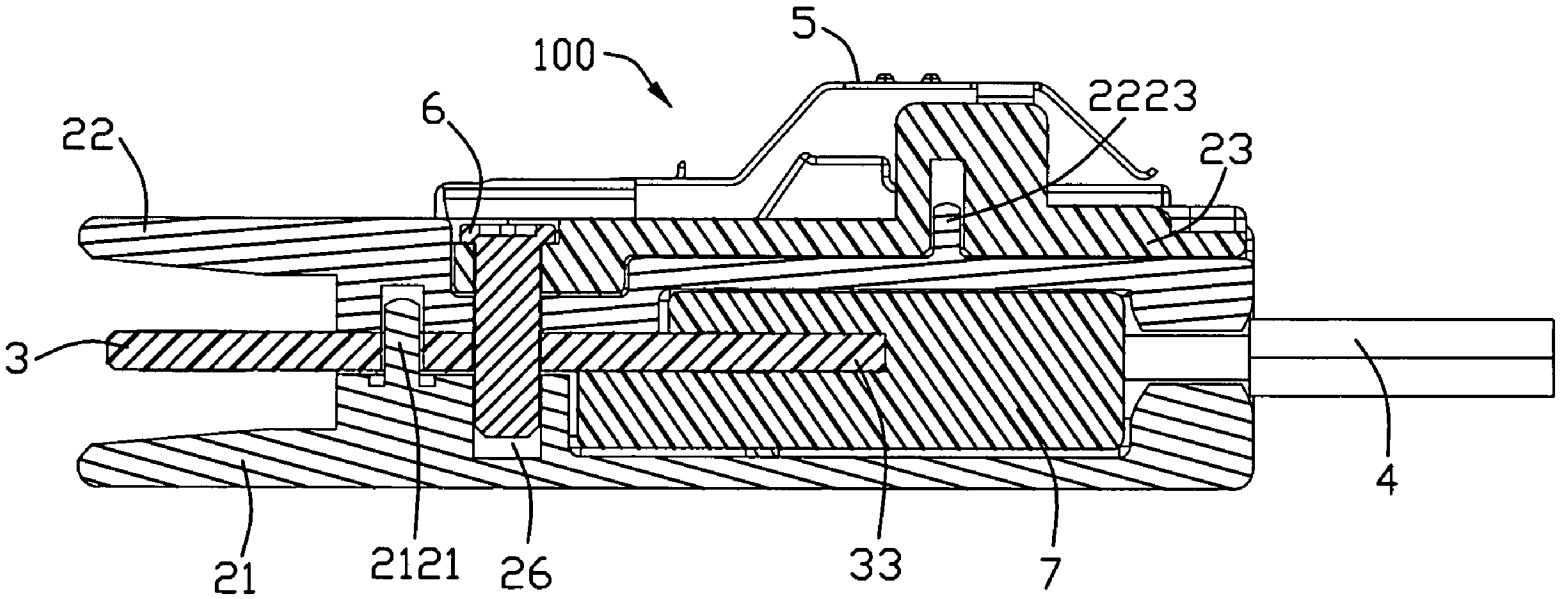
FIG. 11 is a cross section view of the cable assembly of FIG. 1 taken along line 11-11.
Figure 12:
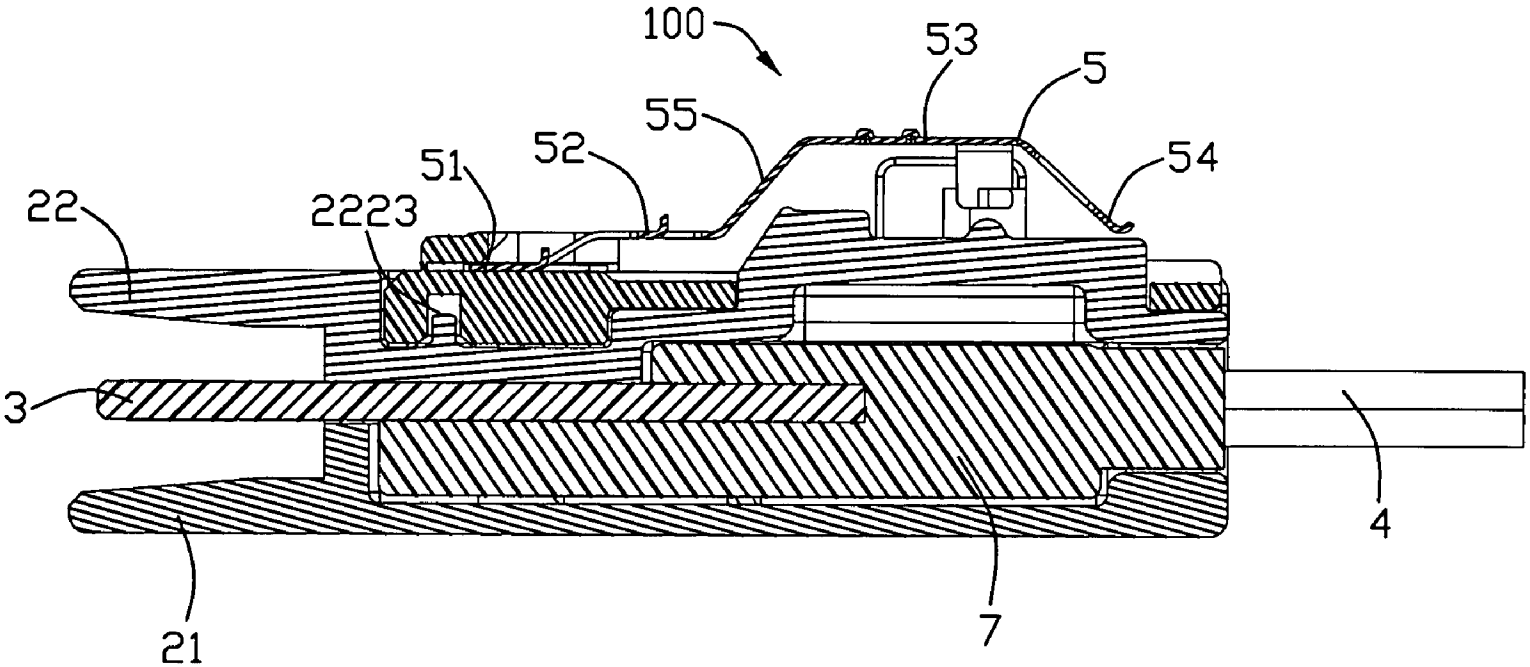
FIG. 12 is a cross section view of the cable assembly of FIG. 1 taken along line 12-12.
Figure 13:
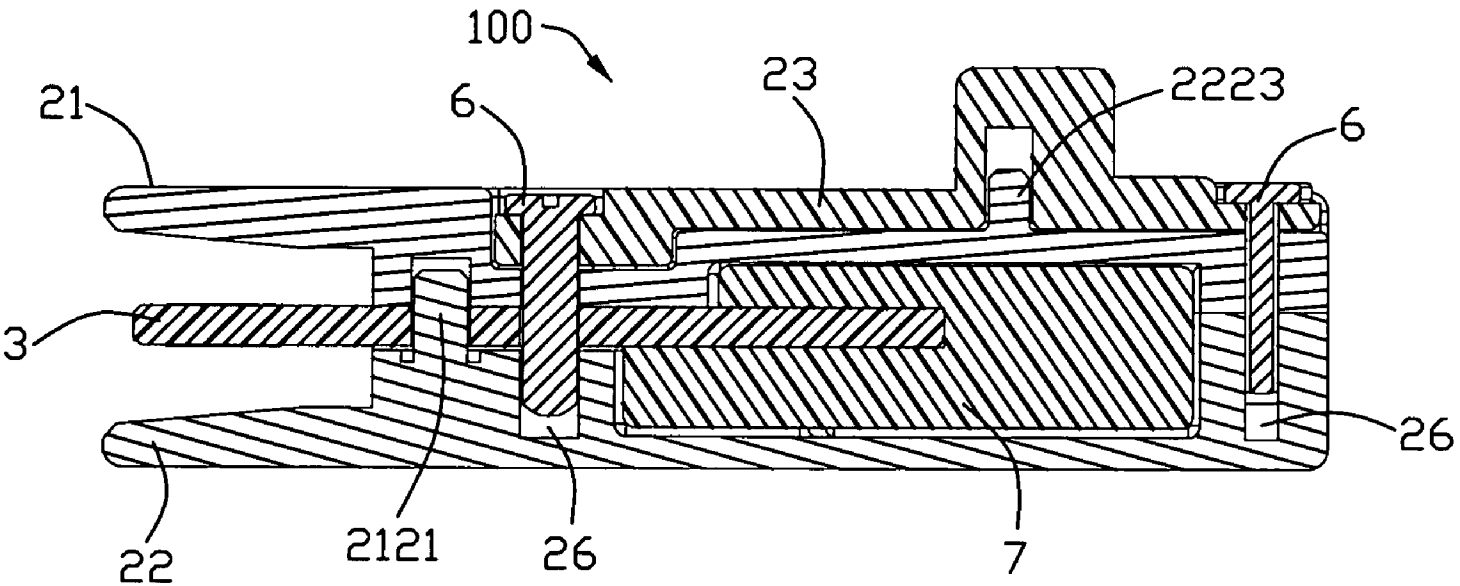
FIG. 13 is a cross section view of the cable assembly of FIG. 1 taken along line 13-13.

Referring to FIGS. 1 to 4 in conjunction with FIGS. 11 to 13, a printed circuit board 3 disposed in the housing 2 defines a mating portion 31 with a plurality of conductive pads 311 thereon, a terminating portion 33 opposite to the mating portion 31 with a plurality of conductive pads (not shown) for terminating to a plurality of cables 4 and a connecting portion 32 connected with the mating portion 31 and the terminating portion 33. The conductive pads 311 are arranged on opposite upper and lower surfaces of the mating portion 31 of the printed circuit board 3 in a transverse direction. The connecting portion 32 defines a pair of front holes 321 disposed at two sides thereof and a pair of rear holes 322 disposed at back of the pair of front holes 321. The pair of front holes 321 of the printed circuit board 3 allow the pair of positioning posts 2121 of the lower cover 21 to pass through.

Referring to FIGS. 1 to 5, a plurality of cables 4 terminated to the printed circuit board 3 are comprised by two sets of sub-assemblies in a stacked relationship. Each sub-assembly comprises four serial Attached Technology Attachment (ATA) standard cables for high speed signal transmission.

Referring to FIGS. 1 to 5, an inner molding 7 is formed on a connection between the printed circuit board 3 and the cables 4 using injection molding process. The terminating portion 33 of the printed circuit board 3 is also surrounded by the inner molding 7.

Referring to FIGS. 1 to 5 in conjunction with FIG. 12, the latch 5 is stamped and formed from a metallic plate and comprises a retaining portion 51, a pair of generally L-shape locking portions 52 extending upwardly and rearwardly from the retaining portion 51, a N-shaped pressing portion 53 formed at a rear position of the pair of locking portions 52, and an inclined supporting portion 54 slantwise extending from the pressing portion 53. The latch 5 further defines an inclined intermediate portion 55 connecting the pressing portion 53 with the locking portions 52. The pressing portion 53 defines a pair of spring tab 531 disposed at two sides thereof.

Figure 9:
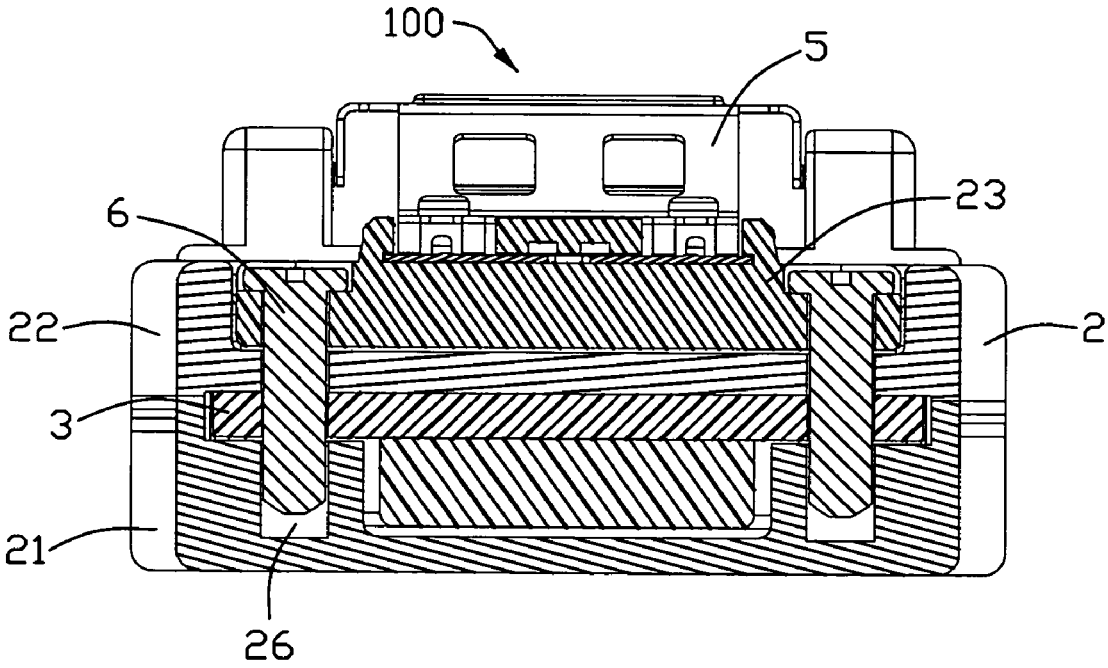
FIG. 9 is a cross section view of the cable assembly of FIG. 1 taken along line 9-9.
Figure 10:
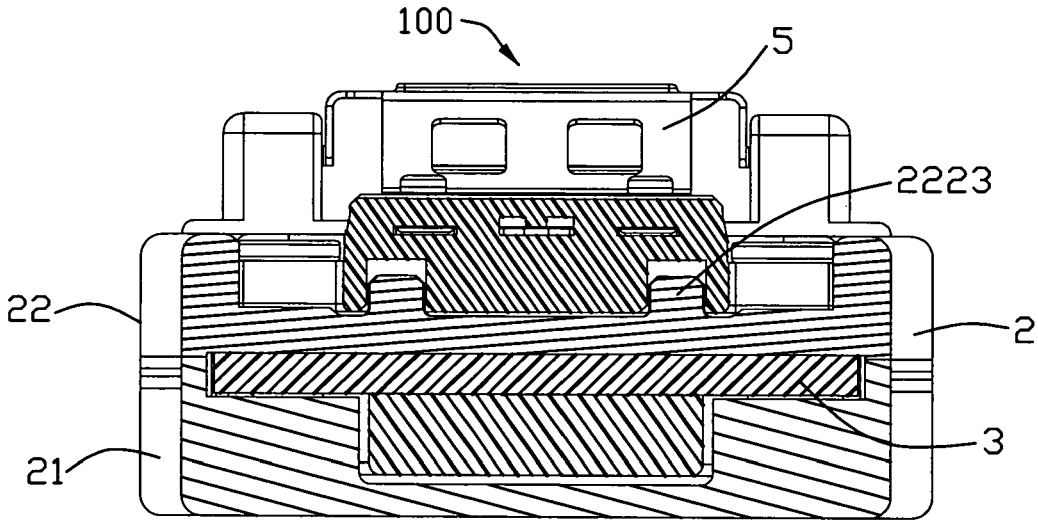
FIG. 10 is a cross section view of the cable assembly of FIG. 1 taken along line 10-10.

Referring to FIGS. 1 to 4 in conjunction with FIGS. 9, 11 and 13, four engaging means 6, such as screws, are used for locking with the lower cover 21, the printed circuit board 3, the upper cover 22 and the stand 23 together. Each screw 6 defines a cylindrical thread portion 61 and an operating portion 62.

Referring to FIGS. 1 to 8 in conjunction with FIGS. 9 to 13, the assembling process of the cable assembly 100 made in according to the present invention starts from arranging the cables 4 into two levels and soldering the cables 4 to the printed circuit board 3.

After the cables 4 are soldered to the printed circuit board 3, then forming an inner molding 7 on a connection between the printed circuit board 3 and the cables 4 using injection molding process. So a PCB module is formed after the above assembling steps. The PCB module is comprised by the printed circuit board 3, the cables 4 and the inner molding 7.

After a PCB module is configured, then assembling the PCB module to the lower cover 21. The inner molding 7 has a lower portion (not figured) formed on a bottom surface of the printed circuited board 3 and received into the recess 2123 of the lower cover 21. And a pair of positioning posts 2121 of the lower cover 21 pass through the pair of front holes 321. Thus, the PCB module is positioned in the lower cover 21 through the lower portion of the inner molding 7 and the pair of positioning posts 2121 cooperated with the lower cover 21.

After the PCB module is assembled to the lower cover 21, then assembling the upper cover 22 to the lower cover 21. The lower surface of the upper cover 22 is attached to the top surface of lower cover 21 after the upper cover 22 assembled to the lower cover 21. Thus, an upper portion (not figured) of the inner molding 7 is received into the groove 2226 of the upper cover 22. And a pair of top ends of the positioning posts 2121 of the lower cover 21 are received into the pair of receiving holes 2221 formed in the lower surface of the upper cover 22.

After the upper cover 22 is assembled to the lower cover 21, then assembling the latch 5 to the stand 23. A forward pressing force is exerted on the latch 5. The retaining portion 51 is engaged with the engaging portion 234 to make the latch 5 positioned on the stand 23. The pressing portion 53, the inclined supporting portion 54, the inclined intermediate portion 55 and the locking portions 52 are cantilevered relative to the retaining portion 51. The pair of spring tabs 531 are respectively received into a pair of openings (not labeled) formed in the pair of ear sections 235. The ear section 2139 can prevent the locking member 5 excessive rebound when the operator withdraw a downward force exerted on the pressing portion 53.

After the latch 5 is assembled to the stand 23, then assembling the latch 5 and stand 23 together to the upper cover 22 in a up to down direction. The stand 23 is received into the recessed area 2225 and four positioning posts 2223 formed in the recessed area 2225 are received into the four receiving holes 231 formed in the bottom surface of the stand 23. The platform 2224 of the upper cover 22 pass through the rectangular through hole 233 and locates below the pressing portion 53, the inclined supporting portion 54 and the inclined intermediate portion 55 of the latch 5. Four through holes 232 of the stand 23 are in alignment with the four through holes 2222 of the upper cover 22. Thus, four receiving holes 26 are formed in the housing 2 for receiving four screws 6. Each receiving hole 26 is defined by a through hole 232 of the stand 23, a through hole 2222 of the upper cover 22 and a receiving hole 2122 of the lower cover 21. A pair of rear holes 322 of the printed circuit board 3 are in alignment with two front receiving holes 26 of the four receiving holes 26 of the housing 2.

Finally, assembling four screws 6 to the housing 2 in an up-to-down direction. The thread portions 61 of the four screws 6 are received into the four receiving holes 26. Thus, the lower cover 21, the upper cover 22, the stand and the printed circuit board 3 are engaged with each other by the four screws 6.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

a housing defining a body portion with a front face, a pair of upper and lower tongue portions respectively extending forwardly from a top and bottom sides of the front face, the housing being defined by a metallic lower cover, a metallic upper cover assembled to the metallic lower cover and an insulative stand assembled to the metallic upper cover;

a printed circuit board disposed in a receiving room of the body portion of the housing and defining a mating portion extending forwardly from the front face of the housing and disposed between the upper and lower tongue portions and a terminating portion opposite to the mating portion;

a cable terminated to the terminating portion of the printed circuit board and extending out of the housing; and a latch assembled upon the insulative stand of the housing and having a front end engaged to a front end of the insulative stand.

2. The cable assembly as recited in claim 1, wherein the cable assembly further comprises engaging means interlocking with the metallic upper cover, the metallic lower cover, the printed circuit board and the insulative stand together.

3. The cable assembly as recited in claim 1, wherein an inner molding is formed on a connection between the printed circuit board and the cables using injection molding process, and the inner molding is filled in the receiving room.

4. The cable assembly as recited in claim 1, wherein the printed circuit board further has a connecting portion connected with the mating portion and the terminating portion, the connecting portion defines a pair of front holes disposed at two sides thereof and a pair of rear holes disposed in back of the pair of front holes.

5. The cable assembly as recited in claim 4, wherein the metallic lower cover defines a pair of positioning posts passing through the rear holes of the printed circuit board, and extending into a pair of receiving holes formed in a lower surface of the metallic upper cover.

6. The cable assembly as recited in claim 1, wherein the upper cover defines an recessed area on a top surface thereof and a plurality of positioning posts formed in the recessed area.

7. The cable assembly as recited in claim 6, wherein the plurality of positioning posts of the upper cover are received into a plurality of receiving holes formed in a lower surface of the insulative stand.

8. The cable assembly as recited in claim 6, wherein the upper cover has a platform formed in the recessed area and passing through a hole of the insulative stand and located below a portion of the latch.

9. The cable assembly as recited in claim 1, wherein the insulative stand defines an engaging portion formed on a top surface of a front section thereof and a pair of ear sections respectively with an opening toward each other.

10. The cable assembly as recited in claim 9, wherein the latch comprises a retaining portion engaged with the engaging portion of the insulative stand, a pair of locking portions extending upwardly and rearwardly from the retaining portion, a pressing portion formed at a rear position of the pair of locking portions, an inclined supporting portion slantwise extending from the pressing portion and an inclined intermediate portion connecting the pressing portion with the locking portions.

11. The cable assembly as recited in claim 10, wherein the pressing portion of the latch defines a pair of spring tab disposed at two sides thereof and respectively received into a pair of openings of the pair of ear sections.

12. The cable assembly as recited in claim 2, wherein the engaging means comprises a plurality of screws, and the body portion of the housing defines a plurality of receiving holes for receiving the corresponding screws.

13. The cable assembly as recited in claim 12, wherein at least one receiving hole of the housing is configured by a through hole of the insulative stand, a through hole of the metallic upper cover and a receiving hole of the metallic lower cover, and a pair of rear holes of the printed circuit board are in alignment with two receiving holes of the housing.

14. An electrical connector, comprising:

a metallic housing comprised by an upper cover and a lower cover and defining a body portion with a receiving space and a pair of upper and lower tongue portions extending forwardly from a front surface of the body portion;

an insulative stand assembled to the upper cover of the metallic housing;

a PCB module disposed in the receiving space of the metallic housing and comprised by a printed circuit board with a mating portion extending forwardly from the front surface of the metallic housing, a cable terminated to the printed circuit board and extending rearwrdly out of the metallic housing and an inner molding formed on a connection between the printed circuit board and the cable;

a latch assembled to the insulative stand; and engaging means interlocking with the lower cover, the printed circuit board, the upper cover and the insulative stand together.

15. An electrical connector claimed in claim 14, wherein the engaging means is a screw, and each of the lower cover, upper cover, the printed circuit board and the insulative housing has a hole for allowing the screw received therein.

16. An electrical connector claimed in claim 14, wherein the inner molding is filled in the receiving space of the metallic housing.

17. An electrical connector comprising:

a metallic housing including opposite first and second covers commonly sandwiching a printed circuit board therebetween;

a mating port defined on a front portion of the printed circuit board;

a cable connected to a rear portion of the printed circuit board;

an insulative stand assembled upon the first cover;

a deflectable metallic latch assembled to the stand; and a platform formed on one of said stand and said first cover and being compliant with a configuration of the latch and located inside of the latch so as to compliantly support deflection of said latch when said latch is depressed toward the first cover.

18. The electrical connector as claimed in claim 17, wherein said platform is formed on the first cover.

19. The electrical connector as claimed in claim 18, wherein said stand defines an opening through which said platform extends.

20. The electrical connector as claimed in claim 17, wherein a screw extends through the stand, the first cover and the printed circuit board for fastening.

* * * * *